US012092420B1

(12) United States Patent
Sarratt

(10) Patent No.: US 12,092,420 B1
(45) Date of Patent: Sep. 17, 2024

(54) UNIVERSAL CARTRIDGE ADAPTER AND METHOD OF USE

(71) Applicant: Wesley Dale Sarratt, Argyle, TX (US)

(72) Inventor: Wesley Dale Sarratt, Argyle, TX (US)

( * ) Notice: Subject to any disclaimer, the term of this patent is extended or adjusted under 35 U.S.C. 154(b) by 0 days.

(21) Appl. No.: 17/693,832

(22) Filed: Mar. 14, 2022

(51) Int. Cl.
*F41A 9/58* (2006.01)
*F41A 9/37* (2006.01)
*F41A 19/10* (2006.01)

(52) U.S. Cl.
CPC ..... *F41A 9/58* (2013.01); *F41A 9/37* (2013.01); *F41A 19/10* (2013.01)

(58) Field of Classification Search
CPC ..... F41A 9/37; F41A 9/58; F41A 9/72; F41A 9/18; F41C 27/00
USPC ..... 42/106
See application file for complete search history.

(56) References Cited

U.S. PATENT DOCUMENTS 9,772,154 B2 9/2017 Foster
D857,832 S 8/2019 Henry
11,598,596 B2 * 3/2023 Parker ..... F41A 9/58

* cited by examiner

*Primary Examiner* — Reginald S Tillman, Jr.
(74) *Attorney, Agent, or Firm* — Leavitt Eldredge Law Firm; Richard G Eldredge

(57) ABSTRACT

A firearm cartridge adapter for enabling a user to cycle cartridges of varying lengths within a firearm without modification is disclosed. The firearm cartridge adapter comprises a cartridge arrestor, a cartridge support, and a mounting base. The cartridge arrestor includes a low spring constant pivot point, a high spring constant pivot point, and a hard stop. The cartridge support includes a first end and a second end, wherein the second end engages with a top portion of the mounting base, wherein the first end extends from the mounting base. The mounting base includes opposing ends and a pair of mounting flanks.

2 Claims, 11 Drawing Sheets

UNIVERSAL CARTRIDGE ADAPTER AND METHOD OF USE

BACKGROUND

1. Field of the Invention

The present invention relates generally to firearms, and more specifically to a universal cartridge adapter that enables a user to cycle any sized cartridge within a firearm, such as shotguns, without modification, adjustment or hindrance, thereby improving user convenience and the firearm's versatility.

2. Description of Related Art

Firearms are well known in the art for self-defense, hunting, sport, and recreation. One popular type of firearm is the shotgun. Conventional shotguns are designed to fire a cartridge or a shotshell, which typically discharges a number of small pellets called shot, or a single solid projectile called a slug through a barrel with a smooth bore. The bore size of conventional shotguns can range from 12-gauge, 16-gauge, 20-gauge, 28-gauge and 0.410 bore. In addition, the length of cartridges can range. In particular, cartridge lengths for 12-gauge shotguns are generally 2¾ inches, 3 inches, and 3½ inches.

Recently, cartridge manufacturers have introduced shorter length cartridges (e.g., 1¾ inches) designed to lower recoil. Unfortunately, however, many current shotguns are not able to cycle these shorter length cartridges. Users wishing to benefit from these shorter length cartridges must purchase a new shotgun or other firearm that is developed to accommodate the shorter length cartridge, which can get prohibitively expensive. While users may also utilize an adapter to enable a shotgun to cycle the shorter length cartridge, the adapter is temporary and must be removed to cycle longer length cartridges. Because of this, there is a need for an adapter that allows a user to cycle any length cartridge within a shotgun without modification.

Accordingly, it is an object of the present invention to provide a universal cartridge adapter developed for the purpose of cycling continuously through various sized cartridges within a firearm without modification.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
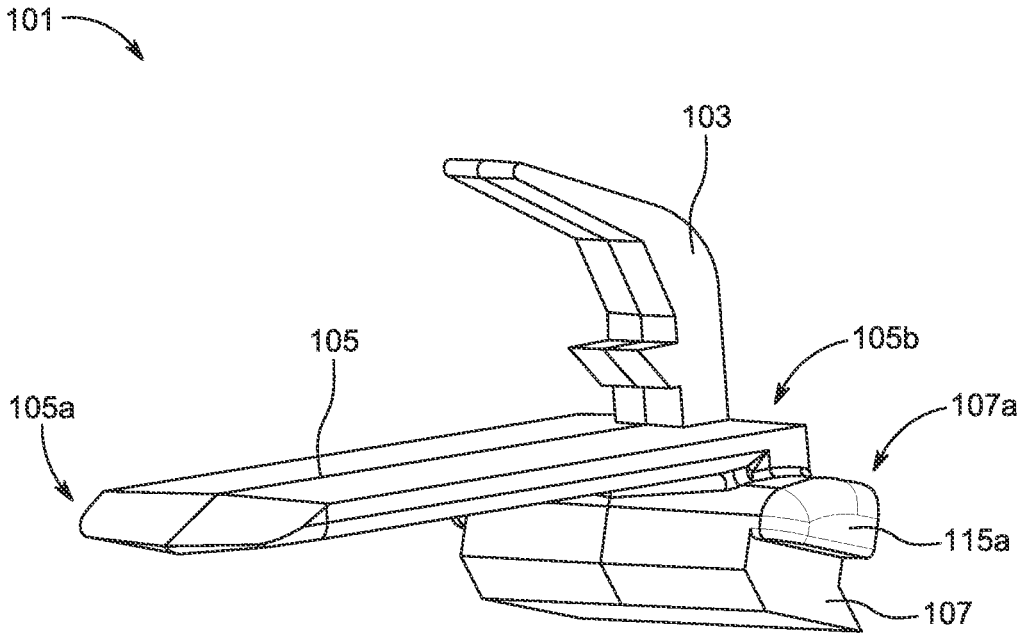
FIG. 1A is a perspective view of a universal cartridge adapter in accordance with a preferred embodiment of the present invention.
Figure 1B:
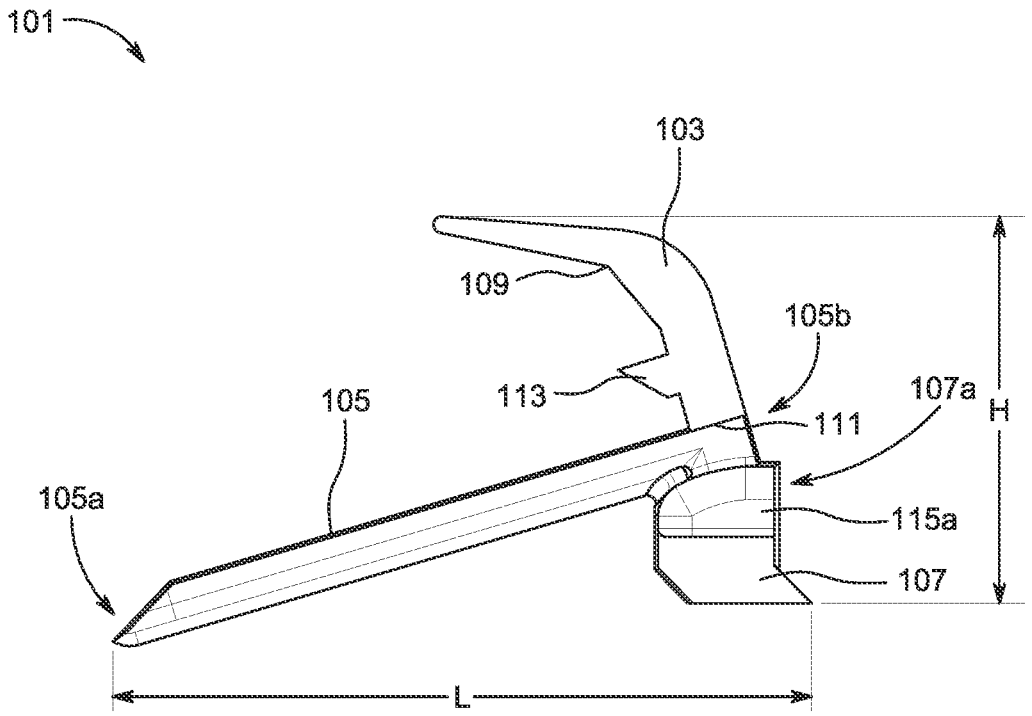
FIG. 1B is a profile view of the universal cartridge adapter of FIG. 1A.
Figure 1C:
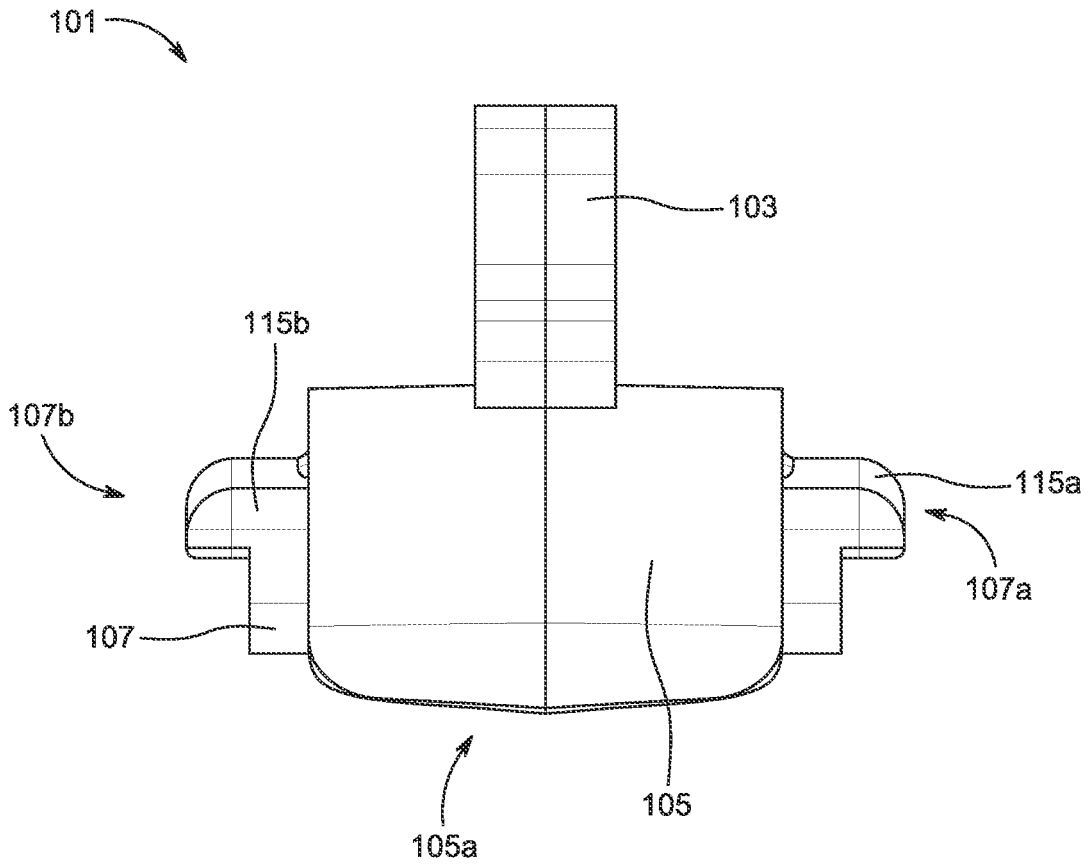
FIG. 1C is a front view of the universal cartridge adapter of FIG. 1A.
Figure 1D:
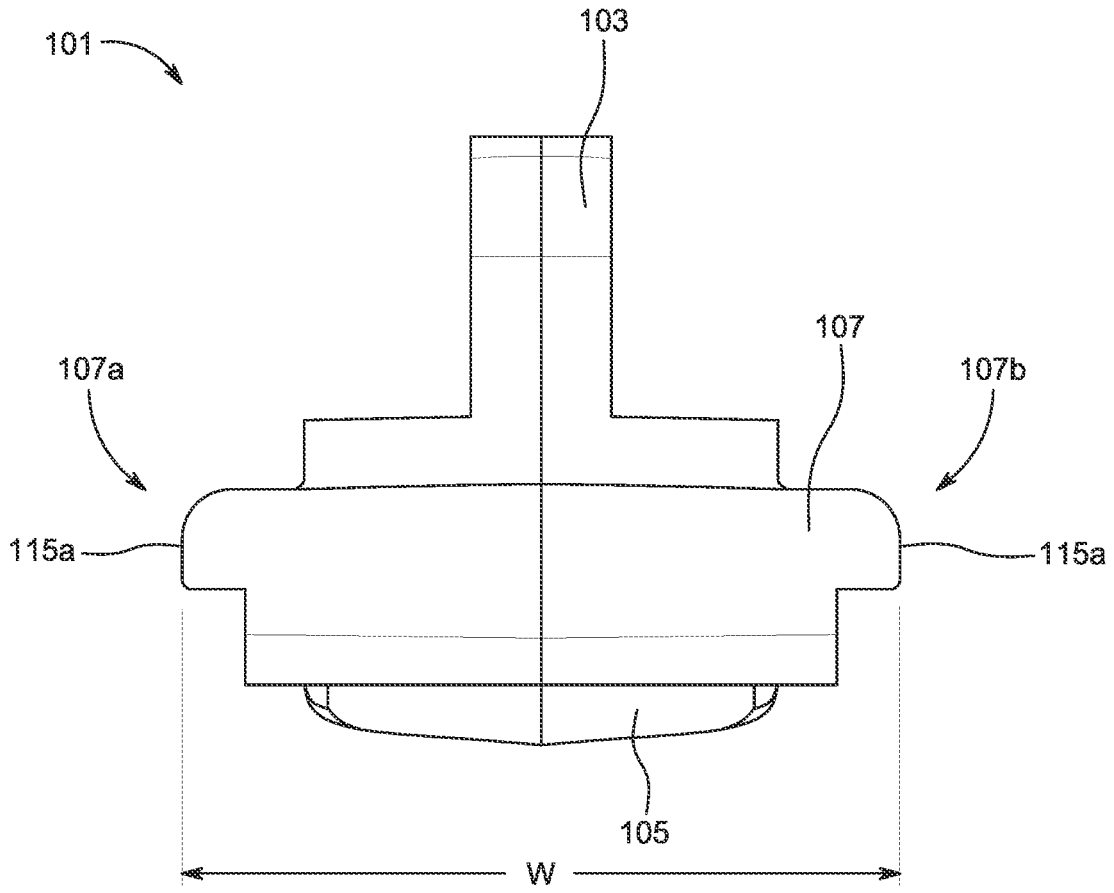
FIG. 1D is a rear view of the universal cartridge adapter of FIG. 1A.
Figure 1E:
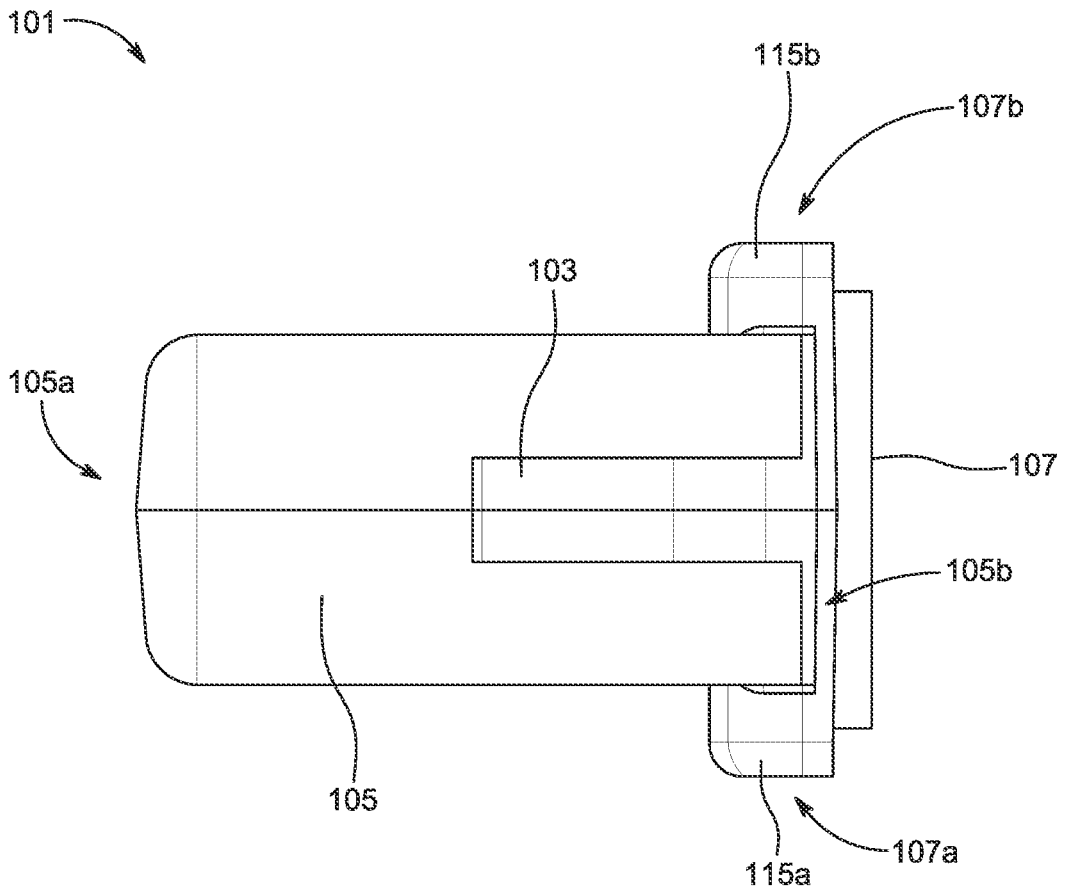
FIG. 1E is a top view of the universal cartridge adapter of FIG. 1A.
Figure 1F:
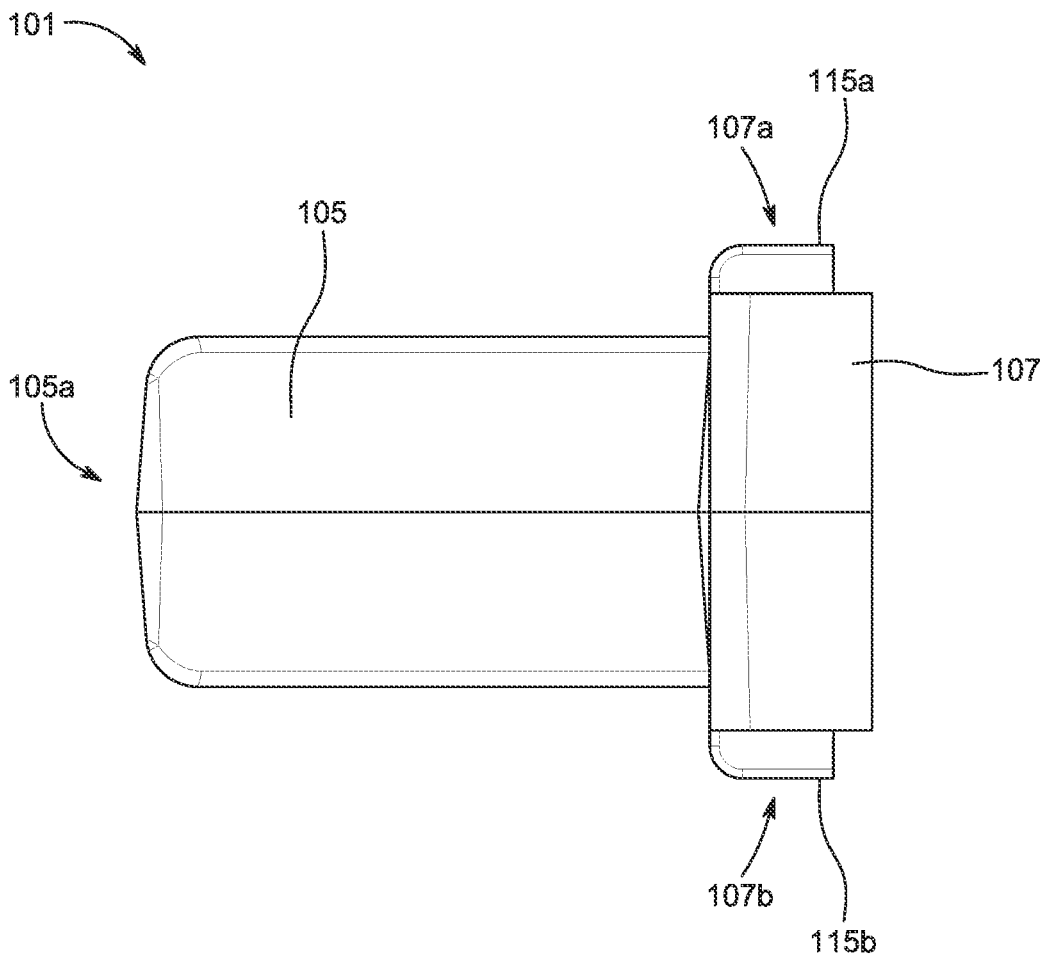
FIG. 1F is a bottom view of the universal cartridge adapter of FIG. 1A.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional firearms. Specifically, the present invention provides a means to cycle cartridges of varying lengths within a firearm without modification. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Reference in the specification to "firearm" or "firearms" means any portable weapon designed to be readily carried and used by an individual. Examples of firearms include, but without limitation, shotguns, rifles, handguns, pistols, revolvers, and the like.

Referring now to the drawings wherein like reference characters identify corresponding or similar elements throughout the several views, FIGS. 1A through 1F depict various views of a universal cartridge adapter 101 in accordance with a preferred embodiment of the present application. It will be appreciated that the adapter 101 overcomes one or more of the above-listed problems commonly associated with conventional firearms.

In the contemplated embodiment, the adapter 101 comprises of a cartridge arrestor 103, a cartridge support 105 having a first end 105*a* and a second end 105*b*, and a mounting base 107. The cartridge arrestor 103 engages with a top portion of the second end 105*b* of the cartridge support 105. The second end 105*b* engages with a top portion of the mounting base 107, with the first end 105*a* extending therefrom.

The cartridge arrestor 103 includes a low spring constant pivot point 109, a high spring constant pivot point 111, and a hard stop 113. Pivot point 109 provides for a soft initial contact of the cartridge upon magazine ejection. Pivot point 111 provides for stopping power upon magazine ejection. Hard stop 113 prevents shorter length cartridges from overtraveling upon magazine ejection.

The mounting base 107 includes a pair of mounting flanks 115*a*, 115*b*, generally referred to as mounting flanks 115, located proximate the opposing ends 107*a*, 107*b*, respectively. The mounting flanks 115 provide a pivot point for the cartridge arrestor 103 to utilize energy from a magazine ejection to rotate the cartridge support 105 toward a firearm's chamber when loading longer cartridges, thereby providing loading assistance.

It should be appreciated that the universal cartridge adapter 101 may be made from any suitable or desired materials, including conventional materials known and used in the art, such as silicone rubbers, natural rubbers, thermoplastic polyurethane rubbers, and the like.

Figure 2A:
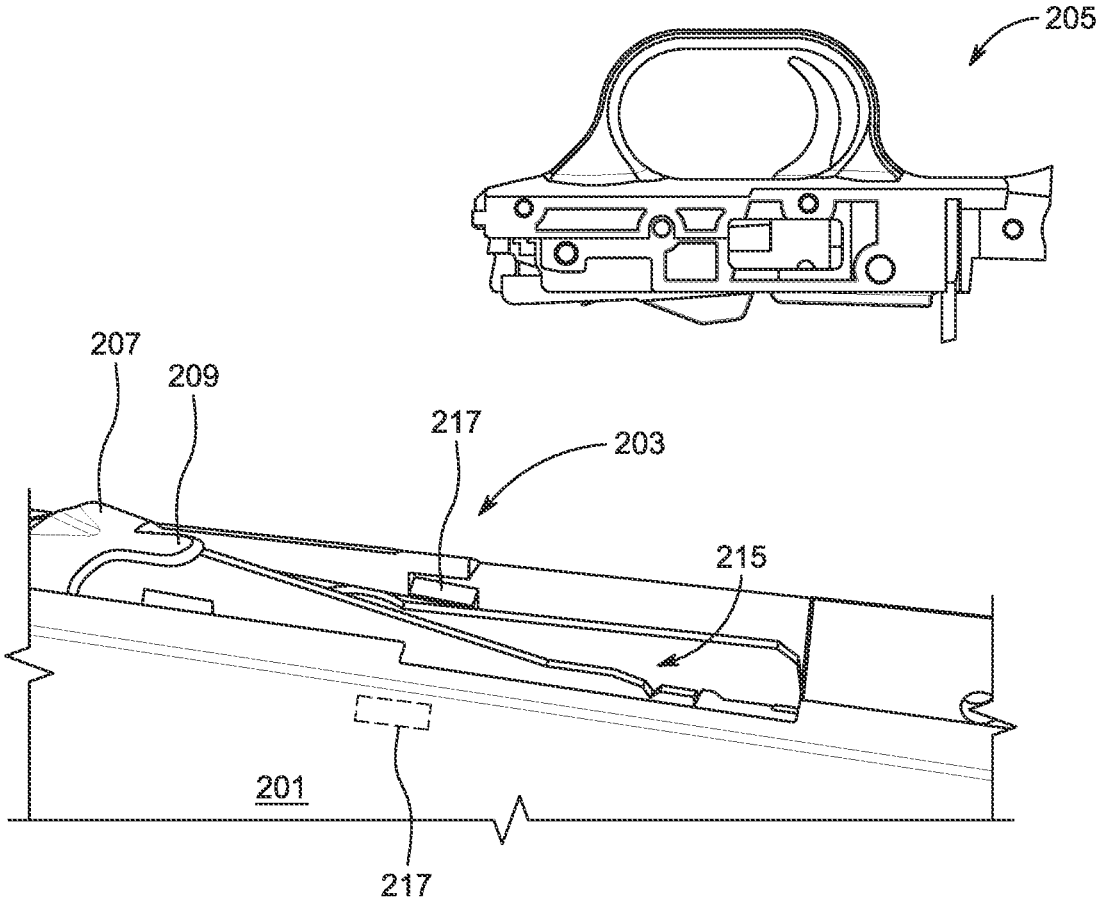
FIG. 2A is a closeup bottom perspective view of a conventional firearm, illustrating a receiver with a trigger assembly removed.
Figure 2B:
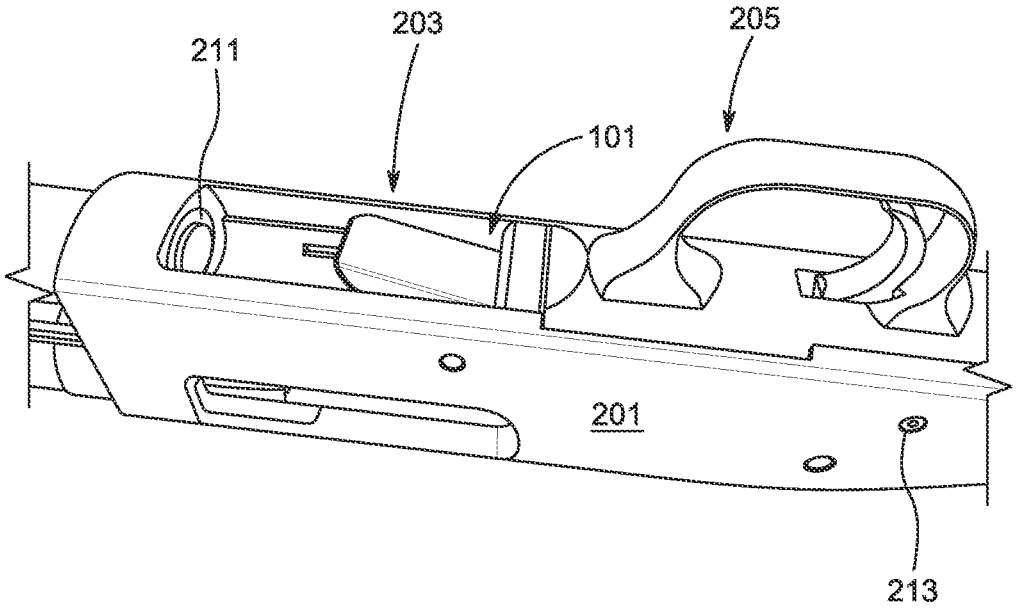
FIG. 2B is a closeup bottom perspective view of the conventional firearm of FIG. 2A, illustrating the universal cartridge adapter of FIG. 1A installed within the receiver.
Figure 2C:
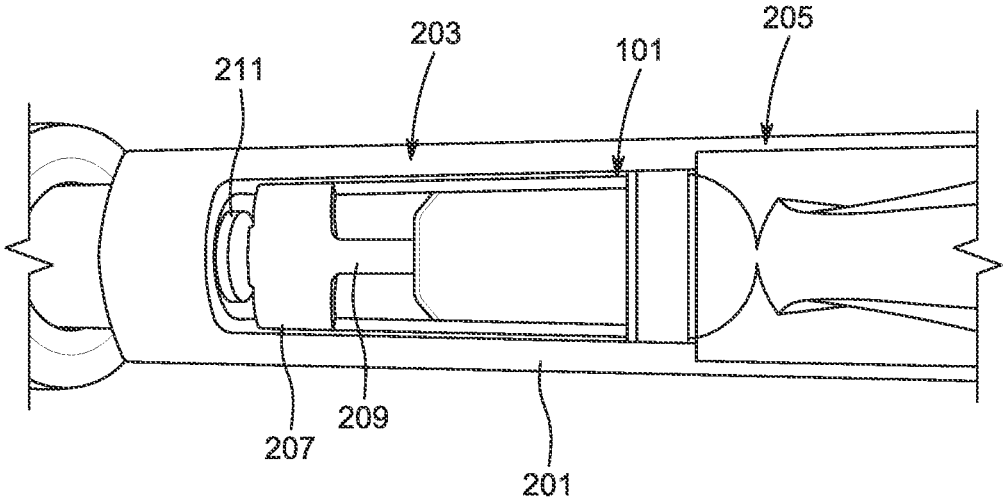
FIG. 2C is a closeup bottom view of the conventional firearm of FIG. 2A, illustrating the universal cartridge adapter of FIG. 1A installed within the receiver.

Referring now to FIGS. 2A through 2C, various closeup views of a conventional firearm 201 are depicted. As shown, the firearm 201 includes a receiver 203, a trigger assembly 205, a lifter assembly 207 with a lifter tongue 209, a magazine port 211, and a trigger housing retaining pin 213. It should be appreciated that in FIG. 2A, the trigger assembly 205 is shown removed from the receiver 203 for illustrative purposes.

The receiver 203 includes an interior cavity 215 configured to house the trigger assembly 205, the lifter assembly 207, and the magazine port 211. The interior cavity 215 also includes a pair of mounting slots 217.

It should be appreciated that during use, the universal cartridge adapter 101 is inserted into the interior cavity 215 by sliding the mounting flanks 115 into the mounting slots 217. The user may then load cartridges of varying length into the firearm 201 and cycle through the cartridges until empty. When a shorter length cartridge is loaded, the cartridge support 105 engages with the lifter assembly 207 to support the shorter length cartridge, thereby preventing the shorter length cartridge from snagging the lifter tongue 209 and from falling through the lifter assembly 207. For longer length cartridges, the cartridge support 105 utilizes the longer length cartridge's kinetic energy to disengage from the lifter assembly 207, thereby allowing the universal cartridge adapter 101 to rotate on the mounting slots 217, thereby assisting longer length cartridges into the chamber during cartridge chambering.

It should be appreciated that when a cartridge is ejected from the magazine port 209, the cartridge arrestor 103 decelerates and absorbs the cartridge's kinetic energy in a controlled manner, thereby preventing shorter length cartridges from "flipping" within the interior cavity 215. In addition, the cartridge arrestor 103 prevents shorter length cartridges from snagging the lifter tongue 209 by holding the cartridge forward and away from the edge of the lifter tongue 209 during magazine ejection as well as subsequent chambering. Further, the cartridge arrestor 103 utilizes the kinetic energy of longer length cartridges to create torque around the mounting slots 217 in order to release the cartridge support 105 released from the lifter tongue 209 and to rotate the cartridge support 105 up toward the chamber (not shown).

It should also be appreciated that one of the unique features believed characteristic of the present application is that the universal cartridge adapter 101 may be used as a semi-permanent internal installation within a firearm, thereby enabling the user to load any combination of cartridge lengths into the firearm and continuously cycle the cartridges until empty without modification.

Figure 3:
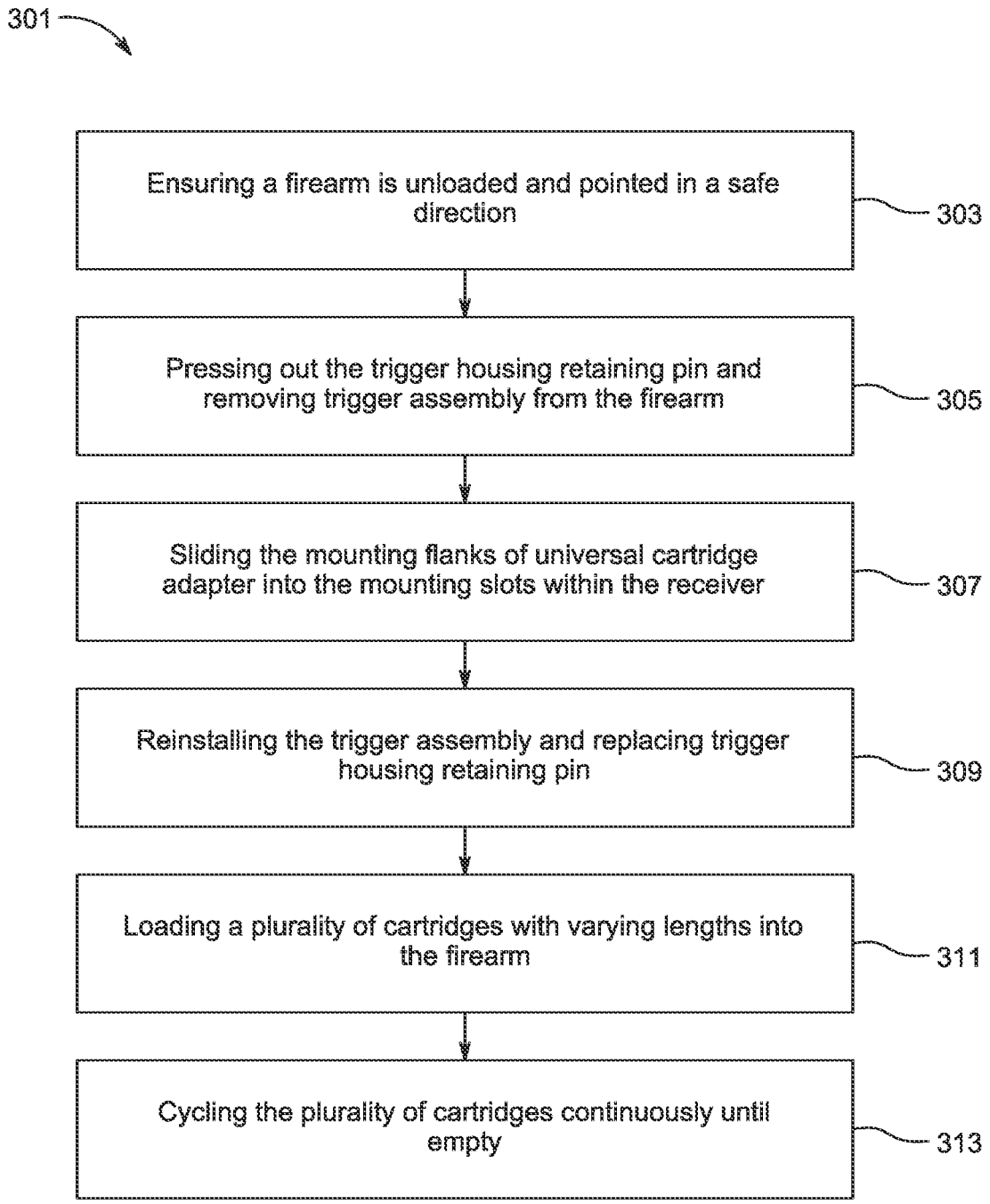
FIG. 3 is a flowchart of a method of using a universal cartridge adapter with a firearm in accordance with the present invention.

In FIG. 3, a flowchart 301 depicts a method of using a universal cartridge adapter with a firearm in accordance with the present invention. Once a firearm is ensured to be completely unloaded and pointed in a safe direction, the trigger housing retaining pin is pressed out and the trigger assembly is removed from the firearm, as shown with boxes 303, 305. The universal cartridge adapter is then installed into the receiver by sliding the mounting flanks into the mounting slots, as shown with box 307. The trigger assembly is reinstalled in the firearm and the trigger housing retaining pin is replaced, as shown with box 309. The user may then load a plurality of cartridges with varying lengths into the firearm, as shown with box 311. The user may then proceed to cycle the plurality of cartridges continuously until empty, as shown with box 313.

Figure 4:
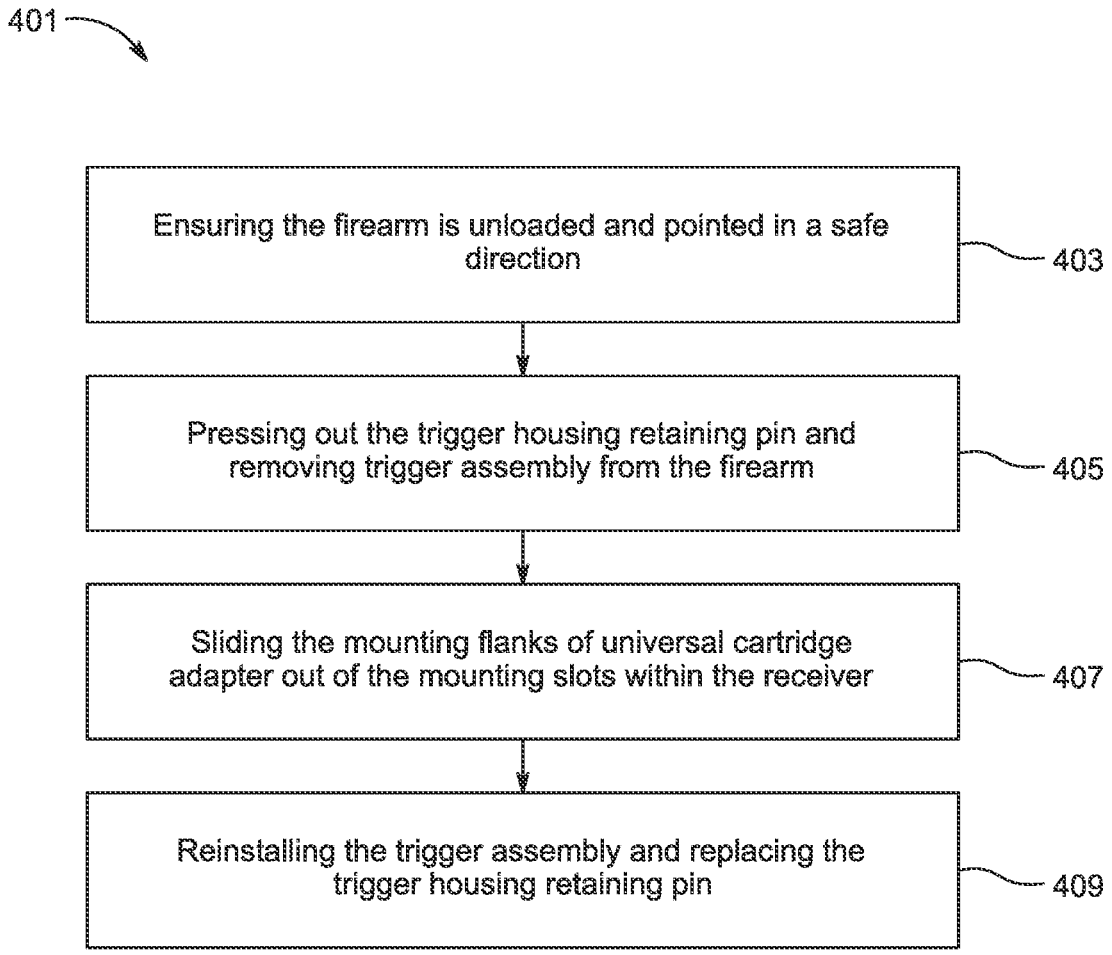
FIG. 4 is a flowchart of a method of removing a universal cartridge adapter installed within a firearm in accordance with the present invention.

In FIG. 4, a flowchart 401 depicts a method of removing a universal cartridge adapter installed within a firearm in accordance with the present invention. First, the firearm is ensured to be completely unloaded and pointing in a safe direction, as shown with box 403. Then, the trigger housing retaining pin is pressed and the trigger assembly is removed from the firearm, as shown with box 405. Next, the universal cartridge adapter is removed from the receiver by sliding the mounting flanks out of the mounting slots, as shown with box 407. Lastly, the trigger assembly is reinstalled and the trigger housing retaining pin is replaced, as shown with box 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A firearm cartridge adapter, comprising:

a cartridge arrestor, the cartridge arrestor having:

a low spring constant pivot point;

a high spring constant pivot point; and a hard stop;

a cartridge support having a first end and a second end; and a mounting base, the mounting base having:

opposing ends; and a pair of mounting flanks configured to removably insert into a pair of mounting slots within a firearm;

wherein each mounting flank is located proximate an opposing end;

wherein the cartridge arrestor engages with a top portion of the second end of the cartridge support;

wherein the second end of the cartridge support engages with a top portion of the mounting base; and wherein the first end of the cartridge support extends from the top portion of the mounting base.

2. A method for cycling a plurality of cartridges having varying lengths within a firearm continuously without modification, the method comprising:

providing a firearm cartridge adapter, the firearm cartridge adapter comprising:

a cartridge arrestor, the cartridge arrestor having:

a low spring constant pivot point;

a high spring constant pivot point; and a hard stop;

a cartridge support having a first end and a second end; and a mounting base, the mounting base having:

opposing ends; and a pair of mounting flanks configured to removably insert into a pair of mounting slots within a firearm;

wherein each mounting flank is located proximate an opposing end;

wherein the cartridge arrestor engages with a top portion of the second end of the cartridge support;

wherein the second end of the cartridge support engages with a top portion of the mounting base; and wherein the first end of the cartridge support extends from the top portion of the mounting base;

pressing out a trigger housing retaining pin from a firearm;

removing a trigger assembly from the firearm;

sliding the mounting flanks of the universal cartridge adapter through a pair of mounting slots within a receiver of the firearm;

reinstalling the trigger assembly into the firearm;

replacing the trigger housing retaining pin in the firearm;

loading a plurality of cartridges into the firearm, the plurality of cartridges having varying lengths; and cycling the plurality of cartridges continuously until empty.

* * * * *